US008772684B2

(12) United States Patent
Isoda et al.

(10) Patent No.: US 8,772,684 B2
(45) Date of Patent: Jul. 8, 2014

(54) HEATING COOKER HAVING TOUCH CONTROL

(75) Inventors: Keiko Isoda, Hyogo (JP); Ryuuji Nagata, Hyogo (JP); Chikashi Satou, Hyogo (JP); Tsuyoshi Inada, Osaka (JP)

(73) Assignee: Panasonic Corporation, Osaka (JP)

( * ) Notice: Subject to any disclaimer, the term of this patent is extended or adjusted under 35 U.S.C. 154(b) by 340 days.

(21) Appl. No.: 12/514,017

(22) PCT Filed: Nov. 12, 2007

(86) PCT No.: PCT/JP2007/071892

§ 371 (c)(1), (2), (4) Date: May 7, 2009

(87) PCT Pub. No.: WO2008/062683

PCT Pub. Date: May 29, 2008

(65) Prior Publication Data

US 2010/0020534 A1 Jan. 28, 2010

(30) Foreign Application Priority Data

Nov. 22, 2006 (JP) ..... 2006-315231

(51) Int. Cl.
*H05B 6/12* (2006.01)
*H05B 3/02* (2006.01)
*F24C 7/08* (2006.01)

(52) U.S. Cl.
CPC ..... *F24C 7/086* (2013.01)
USPC ..... 219/622; 219/625; 219/489

(58) Field of Classification Search
USPC ..... 219/622, 489, 506, 440, 492, 501, 507, 219/508, 663, 667, 668, 704, 710, 720, 219/625; 200/314; 362/97.1; 327/517
See application file for complete search history.

(56) References Cited

U.S. PATENT DOCUMENTS 4,308,443 A * 12/1981 Tucker et al. ..... 219/627
4,446,350 A * 5/1984 Mizukawa et al. ..... 219/622

(Continued)

FOREIGN PATENT DOCUMENTS

JP 63-172803 U 11/1988
JP 5-302721 A 11/1993

(Continued)

OTHER PUBLICATIONS

International Search Report issued Feb. 12, 2008 in International application No. PCT/JP2007/071892, 6 pages.

(Continued)

*Primary Examiner* — Henry Yuen
*Assistant Examiner* — Hemant Mathew
(74) *Attorney, Agent, or Firm* — Brinks Gilson & Lione

(57) ABSTRACT

Operability of a heating cooker having a heating unit in a top plate is improved. After power-on, a light emission control unit causes the operation unit light-emitting element of an operable operation inhibition releasing key to be lit so that only the key is displayed and the other keys are less visible. Thus, the heating cooker is changed into a lock state. When the operation inhibition releasing key is operated in the lock state, at least one electrostatic touch key other than the operation inhibition releasing key is made operable and the operation unit light-emitting element is lit. Alternatively, in the above structure, the operation unit light-emitting element of the operable operation unit is lit in a first light-emission color, and the operation unit light-emitting elements of the inoperable operation units are lit in a second light-emission color different from the first light-emission color. Thus effective operation can be guided.

13 Claims, 9 Drawing Sheets

(56) References Cited

U.S. PATENT DOCUMENTS

| | | | | |
|---|---|---|---|---|
| 5,212,122 | A | 5/1993 | Pannhorst et al. | |
| 5,876,106 | A * | 3/1999 | Kordecki | 362/29 |
| 6,198,080 | B1 | 3/2001 | Rice et al. | |
| 6,809,301 | B1 * | 10/2004 | McIntyre et al. | 219/506 |
| 7,335,861 | B2 * | 2/2008 | Gama et al. | 219/506 |
| 7,499,003 | B2 * | 3/2009 | Rudolph et al. | 345/56 |
| 2005/0127064 | A1 * | 6/2005 | Garcia et al. | 219/492 |

FOREIGN PATENT DOCUMENTS

| | | | | |
|---|---|---|---|---|
| JP | 2001-51777 | A | | 2/2001 |
| JP | 2001-051777 | A | | 2/2001 |
| JP | 2002-177143 | A | | 6/2002 |
| JP | 2002-257356 | A | | 9/2002 |
| JP | 2002-357326 | A | | 12/2002 |
| JP | 2003-142244 | A | | 5/2003 |
| JP | 2003-208972 | A | | 7/2003 |
| JP | 2005-38739 | A | | 2/2005 |
| JP | 2005-038739 | A | | 2/2005 |
| JP | 2005216585 | A | * | 8/2005 ..... H05B 6/12 |
| JP | 2005-265207 | A | | 9/2005 |
| JP | 2005-265212 | A | | 9/2005 |
| JP | 2005-339936 | A | | 12/2005 |
| JP | 2006-128019 | A | | 5/2006 |
| WO | WO 2005/098774 | A2 | | 10/2005 |

OTHER PUBLICATIONS

Extended European Search Report for European Application No. 07831622.1, dated Oct. 28, 2011, 13 pages.

* cited by examiner

HEATING COOKER HAVING TOUCH CONTROL

TECHNICAL FIELD

The present invention relates to a heating cooker in which operation units thereof are lit.

BACKGROUND ART

A block structural diagram of such a type of conventional electronic appliance 100 is shown in FIG. 8. As shown in FIG. 8, electronic appliance 100 has data bus 101. Storage unit 102 is connected to this data bus 101. The storage unit stores operation guiding information substantially covering the specifications of electronic appliance 100. Operation guiding information is prepared for the operating procedures predetermined for electronic appliance 100.

Storage unit 102 is formed of a read-only memory (ROM). To this storage unit 102, display unit 103 is connected via data bus 101. The operation guiding information read from storage unit 102 is displayed on display unit 103.

Selecting unit 104 is connected to this display unit 103 via data bus 101. When a user selects an operation guiding mode with mode selecting unit 109, options for selecting a desired function of electronic appliance 100 are displayed on display unit 103. In order to select one of the displayed options and select a desired function among a plurality of functions, the user operates selecting unit 104.

Light-emitting operating bodies 106 to be operated for executing a function are connected to this selecting unit 104, via data bus 101 and I/O interface unit 105. Operation of this selecting unit 104 causes predetermined light-emitting operating body 106 to flash.

Thus this flash allows the user to identify the mounting position of light-emitting operating body 106. Further, the name of light-emitting operating body 106 displayed on display unit 103 allows the user to identify the name and mounting position of light-emitting operating body 106 without reading the manual.

Sound generating unit 107 is connected to this data bus 101. Operation of light-emitting operating body 106 in a flashed part causes the generation of a confirmation sound, such as a peep.

This confirmation sound of a peep is generated so that the user can confirm that a designated push button, for example, has been pressed. This pressing operation of the push button triggers the readout of the next operation guiding information from storage unit 102 to display unit 103.

Alternatively, operation of light-emitting operating body 106 in a non-flashed part may cause the generation of an alarm sound, such as repeated peeps. Sound generating unit 107 has speech processing circuit 107A for generating a confirmation sound of a peep and an alarm sound of repeated peeps, and speaker 107B for generating these confirmation sound and alarm sound. For audio equipment, speech processing circuit 107A and speaker 107B are provided therein, and thus may be used in common for the above purpose.

Control unit 108 is connected to this sound generating unit 107 via data bus 101. Control unit 108 controls the generation of sound generating unit 107 so that the operation of light-emitting operating body 106 is confirmed. Control unit 108 is formed of a central processing unit (CPU), for example. Control unit 108 controls display unit 103 so that the next operating step is displayed. The control unit also controls the light emission so that light-emitting operating body 106 showing the next operation is lit. The sequence of lighting light-emitting operating bodies 106 is pre-stored in storage 102 so that the light-emitting operating bodies are lit in time for the operating steps.

Mode selecting unit 109 is connected to this data bus 101, in addition to storage unit 102, display unit 103, selecting unit 104, I/O interface unit 105, sound generating unit 107, and control unit 108. The mode selecting unit is operated for selecting an operation guiding mode or an operation non-guiding mode. The operation guiding mode refers to a mode in which operations for executing a functional operation of electronic appliance 100 are guided. The operation non-guiding mode refers to a mode in which operation guiding is not performed.

In normal operation, this electronic appliance 100 is set to the operation non-guiding mode. Only when the user desires to use the operation guiding function, the operation guiding mode is selected with mode selecting unit 109. Thus the operation non-guiding mode need not be selected via mode selecting unit 109.

When a user attempts to operate a function less frequently used, the user has forgotten the method for operating electronic appliance 100, in some cases. In another case, the specifications may be lost. In such cases, the user can select the operation guiding mode with mode selecting unit 109 and use the operation guiding function without reading the specifications (see Patent Document 1, for example).

However, the conventional structure has the following problems. The light-emitting operating body is formed of a push button or, a rotating body, such as a jog dial, for example. Thus the user can always identify the light-emitting operating bodies visually in an unlit state. Even when only an operable operating body light-emitting element is lit by a colored light source, the user unaware of the intended purpose thereof may operate a light-emitting operating body unlit but visually identifiable.

In some cases, a countermeasure against erroneous operation is provided. When a light-emitting operating body unlit and inoperative is operated, an alarm sound, such as repeated peeps, is generated. However, in this case, the alarm sound suggests the notification of the cases other than erroneous operation, such as a failure, the sound of a timer, and confuses the user.

Further, the operation necessary for functional operation of the electronic appliance can be guided by lighting the light-emitting element of an operating body expected for operation in the next step. However, when a plurality of operations is selectable in the next step, the user cannot recognize which operation takes the highest priority. Further, when only one operating body light-emitting element is lit for operation guiding, the other operable functions cannot be indicated.

[Patent Document 1] Japanese Patent Unexamined Publication No. 2001-51777

SUMMARY OF THE INVENTION

The present invention addresses the conventional problems, and provides a heating cooker in which a heating unit provided in a top face of the appliance is easily operable and erroneous operation thereof can be prevented.

For this purpose, the heating cooker includes the following elements:

an optically-transparent top plate provided on the top face of the appliance;

a heating unit formed in the top plate;

an electrostatic touch key having an electrode on the rear face of the top plate and used to instruct the execution of a function assigned to the electrostatic touch key, in which the electrode is formed of a light-blocking conductive coating and has an optically-transparent cutting shape;

an operation detecting unit for applying an alternating current signal to the electrode and detecting a capacitance change of the electrode with respect to the ground caused by a contact with a portion of the top plate facing the electrode;

an operation unit light-emitting element for irradiating the electrode with light from the direction opposite to the top plate; and a light emission control unit for controlling light emission by causing the operation unit light-emitting element to be lit so that the shape of the electrode is visible through the top plate, and causing the operation unit light-emitting element to be unlit so that the shape of the electrode is less visible.

After power-on, the appliance is brought into a lock state in which only an operation inhibition releasing key among the electrostatic touch keys is operable.

In the lock state, the light emission control unit causes only the operation unit light-emitting element of the operation inhibition releasing to be lit.

Thereafter, when operation of the operation inhibition releasing key brings the appliance into a state in which at least one electrostatic touch key other than the operation inhibition releasing key is operable, the light emission control unit causes the operation unit light-emitting element of the operable electrostatic touch key to be lit.

With the above structure, only the shape of the electrode of the operable electrostatic touch key is visible through the top plate. In contrast, the shape of the electrode of the inoperable electrostatic touch key is less visible. This structure facilitates operation and improves operability. After the power supply switch is turned on, the appliance is in the lock state, and the electrostatic touch keys other than the operation inhibition releasing key are inoperable. Thus inadvertent operation of the appliance can be prevented. In the lock state, only the operation unit light-emitting element of the operation inhibition releasing key is in the lit state. Thus the position of the operation inhibition releasing key for releasing the lock state can be found easily.

When the light emission control unit has detected that an operable electrostatic touch key is operated, the light emission control unit causes the operation unit light-emitting elements of the electrostatic touch keys made inoperable to be unlit, and causes the operation unit light-emitting elements of the electrostatic touch keys made operable to be lit.

Every time an electrostatic touch key is operated, only the electrostatic touch keys necessary for the next operation are displayed. Thus the electrostatic touch keys necessary for the operation can be found easily.

Alternatively, instead of only the operation unit light-emitting element of the operable electrostatic touch keys being lit, the operation unit light-emitting elements of the operable electrostatic touch keys may be lit in a predetermined first light-emission color and the operation unit light-emitting elements of the other operation units may be lit in a predetermined second light-emission color different from the first predetermined light-emission color.

This structure can also offer the same advantage. With this structure, the user can also identify the positions of the inoperable electrostatic touch keys.

When a plurality of operation units are operable, the operation unit having the highest priority is lit in a first light-emission color, the other operable operation units are lit in a second light-emission color different from the first light-emission color, and the operation unit light-emitting elements of the inoperative electrostatic touch keys are unlit.

Because operable operation units are lit, the user can visually identify the operation units. Among those operation units, only the operation unit having higher priority is lit in a different color. This structure can provide more user-friendly operation guiding.

REFERENCE MARKS IN THE DRAWINGS

Figure 1:
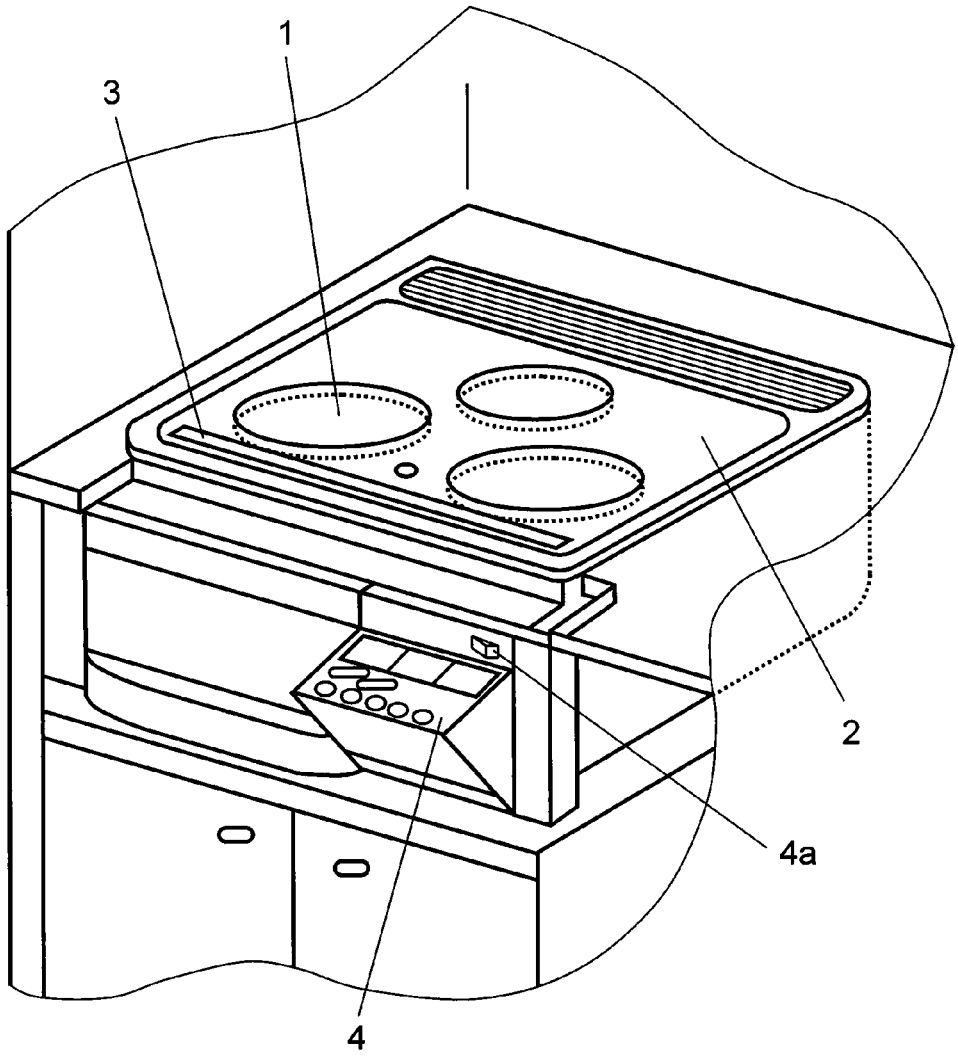
FIG. 1 is an outside view showing a heating cooker in accordance with first and second exemplary embodiments of the present invention.

2 Top plate
3 Top-face operation unit
4*a* Power supply switch
5 Electrostatic touch key
5*b* Electrode
6 Operation detecting unit
7 Light-guiding plate (Operation unit light-emitting element)
7*a* LED (Operation unit light-emitting element)
7*b* Light-guiding plate (Operation unit light-emitting element)
7*c* Operation unit light-emitting element
8 Light emission control unit
12 Storage unit

13 Voice generating unit
14 Guiding operation selecting unit
17 Display unit
18 Lighting failure detecting unit

DETAILED DESCRIPTION OF THE PREFERRED EMBODIMENTS

In accordance with the present invention, a heating cooker includes the following elements:

an optically-transparent top plate provided on the top face of the appliance;

a heating unit formed in the top plate;

an electrostatic touch key having an electrode and used to instruct the execution of a function assigned thereto, in which the electrode is formed of a light-blocking conductive coating and has an optically-transparent cutting shape by removal of a part of the conductive coating;

an operation detecting unit for applying an alternating current signal to the electrode and detecting a capacitance change of the electrode with respect to the ground caused by a contact with a portion of the top plate facing the electrode;

an operation unit light-emitting element for irradiating the electrode with light from the direction opposite to the top plate; and a light emission control unit for controlling light emission by causing the operation unit light-emitting element to be lit so that the shape of the electrode is visible through the top plate, and causing the operation unit light-emitting element to be unlit so that the shape of the electrode is less visible.

After power-on, the appliance is brought into a lock state in which only an operation inhibition releasing key, i.e. the electrostatic touch key, is operable.

In the lock state, the light emission control unit causes lighting up of only the operation unit light-emitting element of the operation inhibition releasing key, which is operable.

Thereafter, when operation of the operation inhibition releasing key brings the appliance into a state in which at least one electrostatic touch key other than the operation inhibition releasing key is operable, the light emission control unit brings the operation unit light-emitting element of the operable electrostatic touch key into a lit state.

Only the shape of the electrode of the operable electrostatic touch key is visible through the top plate. In contrast, the cutting shape of the electrode of an inoperable electrostatic touch key is less visible. This structure facilitates operation and improves operability. Even after the power supply switch is turned on, the appliance is in the lock state, and the electrostatic touch keys other than the operation inhibition releasing key are inoperable. Thus inadvertent operation of the appliance can be prevented. In the lock state, only the operation unit light-emitting element of the operation inhibition releasing key is in the lit state. Thus the position of the operation inhibition releasing key for releasing the lock state can be found easily.

In accordance with the present invention, when the light emission control unit of the heating cooker has detected that an operable electrostatic touch key is operated, the light emission control unit causes the operation unit light-emitting elements of the electrostatic touch keys made inoperable to be unlit, and causes the operation unit light-emitting elements of the electrostatic touch keys made operable to be lit. With this structure, every time an electrostatic touch key is operated, only the electrostatic touch keys necessary for the next operation are displayed. Thus the electrostatic touch key necessary for the operation can be found easily.

The light emission control unit causes only the operation unit light-emitting element of the operable electrostatic touch key to be lit. Alternatively, in accordance with the present invention, instead of the above structure, the light emission control unit causes the operation unit light-emitting elements of the operable electrostatic touch keys to be lit in a predetermined first light-emission color and the operation unit light-emitting elements of the other operation units to be lit in a predetermined second light-emission color different from the first light-emission color. This structure can also offer the same advantage as described above, and allows the user to perform the next operation without reading the specifications or the like.

Further, in accordance with the present invention, the light emission control unit of the heating cooker causes the operation unit light-emitting element to be guided for operation with the highest priority, among the operable electrostatic touch keys, to be lit in a first light-emission color, and the operation unit light-emitting elements of the other operable electrostatic touch keys to be lit in a second light-emission color different from the first light-emission color. Further, the light emission control unit causes the operation unit light-emitting elements of the inoperative electrostatic touch keys to be unlit. With this structure, the user can easily perform the next operation. Because only the operable operation units are visible, the possibility of erroneous operation is eliminated.

Further, in accordance with the present invention, a glass having low optical transparency is used for the top plate of the heating cooker so as to make the shape of the electrode less visible when the operation unit light-emitting element is unlit. Thus, when the operation unit light-emitting element of an inoperable electrostatic touch key is unlit, the shape of the electrode thereof is less visible to the user. This structure reduces the possibility of erroneous operation. When the operation unit light-emitting element of an operable electrostatic touch key is lit, the light transmits through the top plate and the shape of the electrode is visible. Thus the user can perform the next operation easily and correctly.

Alternatively, in accordance with the present invention, a half mirror is used for the top plate of the heating cooker so as to make the shape of the electrode less visible when the operation unit light-emitting element is unlit. Thus, when the operation unit light-emitting element of an inoperable electrostatic touch key is unlit, the shape of the electrode thereof is less visible to the user. This structure reduces the possibility of erroneous operation. When the operation unit light-emitting element of an operable electrostatic touch key is lit, the light transmits through the half mirror and the shape of the electrode is visible. Thus the user can perform the next operation easily and correctly.

Alternatively, in accordance with the present invention, the top plate of the heating cooker and the electrodes in the unlit state have the same color so that the shapes of the electrodes are less visible when the operation unit light-emitting elements are unlit. With this structure, when the operation unit light-emitting element of an inoperable electrostatic touch key is unlit, the electrostatic touch keys and the top plate have the same color and thus the shape of the electrodes are less visible to the user. This structure reduces the possibility of erroneous operation. When the operation unit light-emitting element of an operable electrostatic touch key is lit, the electrode is irradiated with light from the rear face thereof and the shape of the electrode is visible. Thus the user can perform the next operation easily and correctly.

Alternatively, in accordance with the present invention, a thin layer having low optical transparency is formed on the rear face of the top plate of the heating cooker so as to make the shapes of the electrodes less visible when the operation unit light-emitting elements are unlit. With this structure, when the operation unit light-emitting elements of inoperable electrostatic touch keys are unlit, the shape of the electrode is less visible to the user. This structure reduces the possibility of erroneous operation. When the operation unit light-emitting element of an operable electrostatic touch key is lit, the electrode is irradiated with light from the rear face thereof and the shape of the electrode is visible. Thus the user can perform the next operation easily and correctly.

Further, in accordance with the present invention, the heating cooker has a sound generating unit for generating information on an operable operation unit and operating method, in addition to light emission of the operation unit light-emitting element caused by the light emission control unit. With this structure, the user can obtain information on the next operation in both a visual and audio manner, and perform the next operation easily and correctly.

Further, in accordance with the present invention, the heating cooker has a guiding operation selecting unit for instructing to stop the operation for causing the operation unit light-emitting elements to be lit and unlit according to whether the electrostatic touch keys are operable or inoperable. The operation of the guiding operation selecting unit allows the light emission control unit to keep the operation unit light-emitting elements lit all the time. Operation of the guiding operation selecting unit allows the user to select one of the following operations: identification of the positions and functions of all the operation unit light-emitting elements; and a conventional operating method in which all the electrostatic touch keys are displayed. Thus annoying flashes of the electrostatic touch keys can be eliminated.

In accordance with the present invention, a heating cooker includes the following elements:

an optically-transparent top plate provided on the top face of the appliance;

a heating unit formed in the top plate;

an electrostatic touch key having an electrode on the rear face of the top plate and used to instruct the execution of a function assigned thereto, in which the electrode is formed of a light-blocking conductive coating and has an optically-transparent cutting shape by removal of a part of the conductive coating;

an operation detecting unit for applying an alternating current signal to the electrode and detecting a capacitance change of the electrode with respect to the ground caused by a contact with a portion of the top plate facing the electrode;

an operation unit light-emitting element for irradiating the electrode with light from the direction opposite to the top plate; and a light emission control unit for controlling light emission by causing the operation unit light-emitting element to be lit so that the shape of the electrode is visible through the top plate, and causing the operation unit light-emitting element to be unlit so that the shape of the electrode is less visible.

Upon detection of the operation of the electrostatic touch key, the light emission control unit causes the operation unit light-emitting element to be flashed and acceptance of the operation is informed to the user.

This structure allows easy and correct operation. Further, the operation unit light-emitting element of an operable electrostatic touch key is in a lit state. Flashes thereof allow the user to visually confirm that the electrostatic touch key has accepted the operation of the user. This structure can prevent erroneous operation in which the user repeats the same operation because the user cannot confirm the acceptance of the operation.

Further, in accordance with the present invention, the heating cooker includes a storage unit for storing an operating procedure, and the light emission control unit controls the light emission of the operation unit light-emitting elements according to the operating procedure stored in the storage unit. Thus the user can perform the next operation without reading the specifications or the like.

In accordance with the present invention, a heating cooker includes the following elements:

an optically-transparent top plate provided on the top face of the appliance;

a heating unit formed in the top plate;

an electrostatic touch key having an electrode on the rear face of the top plate and used to instruct the execution of a function assigned thereto, in which the electrode is formed of a light-blocking conductive coating and has an optically-transparent cutting shape by removal of a part of the conductive coating;

an operation detecting unit for applying an alternating current signal to the electrode and detecting a capacitance change of the electrode with respect to the ground caused by a contact with a portion of the top plate facing the electrode;

an operation unit light-emitting element for irradiating the electrode with light from the direction opposite to the top plate; and a light emission control unit for controlling light emission by causing the operation unit light-emitting element to be lit so that the shape of the electrode is visible through the top plate, and causing the operation unit light-emitting element to be unlit so that the shape of the electrode is less visible.

The light emission control unit includes a lighting failure detecting unit for detecting a disconnection in the light source of the operation unit light-emitting element, and a display unit.

When the lighting failure detecting unit detects that the operation unit light-emitting element is unlit, the lighting failure detecting unit displays an error on the display unit and informs the user of a lighting failure.

With this structure, when the operation unit light-emitting element is unlit due to a failure, the user is informed of the failure. This structure can prevent the user from inadvertently starting the heating operation and prompt the user to have the appliance repaired.

Hereinafter, exemplary embodiments of the present invention are described with reference to the accompanying drawings. The present invention is not limited by the exemplary embodiments.

First Exemplary Embodiment

FIG. 1 is an outside view showing a heating cooker in accordance with the first exemplary embodiment of the present invention. With reference to FIG. 1, the major components of this heating cooker are as follows: top plate 2 that is provided on the top face of the appliance to receive an object to be heated (not shown) thereon, and formed of a highly heat-resistant, electrically-insulating material, such as a heat-resistant glass made of an optically-transparent crystallized ceramic, into a planar shape; heating unit 1 formed in top plate 2; top-face operation unit 3 formed in top plate 2 on the front side of heating unit 1; and kangaroo-type operation unit 4 that is placed on the front side of the heating cooker and can be advanced and retracted.

In the area of top-face operation unit 3, electrostatic touch keys 5 each for instructing execution of a function assigned thereto are formed. Each electrostatic touch key 5 has electrode 5*b* formed of a light-blocking conductive coating on the rear face of top plate 2. Electrode 5*b* has a portion lacking the conductive coating, i.e. an optically-transparent area, formed into a predetermined shape (cutting shape of a diagram, characters, a symbol, or the like) (see FIG. 4D). Heating unit 1 is formed in top plate 2. A printed film formed in a circular area on the bottom face of top plate 2 to have a size substantially corresponding to the planar shape of the heating coil is displayed as a heatable area of heating unit 1. For an induction heating cooker, an induction heating coil (not shown) for generating a high-frequency magnetic field is provided to face this heatable area as a component of heating unit 1.

Heating unit 1 of the present invention is not limited to such an induction heating type. The heating cooker may be of an electric heater heating type including a heater, e.g. a heating wire and a sheath heater, as a component thereof, or of a gas heating type including a gas burner as a heating source. For example, the gas heating type may have an opening in top plate 2 so that the components of the burner are disposed in the opening. The present invention is applicable to a heating cooker in which heating unit 1 and electrostatic touch keys 5 are formed in top plate 2 provided on the top face of the appliance.

In top plate 2 of the first exemplary embodiment, top-face operation unit 3 is colored black, and substantially the whole part of the other portions is colored silver. In order to color top-face operation unit 3, a printed film colored in a color having low optical transparency is formed on the rear face of top plate 2. When a light-emitting element under top-face operation unit 3 is lit, the light transmitting through the portion in which the light-blocking effect is lost by the removal of the conductive coating is visible. When the light-emitting element is lit, the shape of electrode 5*b* (cutting shape, see key display parts 5*c* and 5*d* in FIG. 4D) can be visually identified through top plate 2. However, when the light-emitting element is unlit, the shape of the electrode is less visible.

The method for coloring top-face operation unit 3 is not limited to the above structure. Instead of forming a printed film, for example, an evaporated film having a half mirror effect may be formed. Instead of forming a colored film, the material of top plate 2, e.g. a crystallized ceramic, may be colored black. In this case, a printed film for coloring need not be formed on top-face operation unit 3 to make the shape of electrode 5*b* (key display parts 5*c* and 5*d*, see FIG. 4C) less visible. Further, top plate 2 and electrode 5*b* in the unlit state may have the same color so that the shape of electrode 5*b* is less visible to the user when light-guiding plate 7 of inoperable electrostatic touch key 5 is unlit. This structure can offer the same advantage as described above.

Top-face operation unit 3 may be formed in a window shape, as shown in FIG. 1, and has a color different from the color of the other portions of top plate 2. Alternatively, the top-face operation unit may have the same color without a window. For example, the whole part of top plate 2 may be colored dark brown and include top-face operation unit 3 in a part thereof. In this case, a line may be printed in a bright color so as to surround top-face operation unit 3 and indicate a window. The window for indicating top-face operation unit 3 is not necessarily provided. When a window is provided to indicate top-face operation unit 3, the user can easily identify the area in which electrostatic touch keys 5 are disposed.

Figure 2:
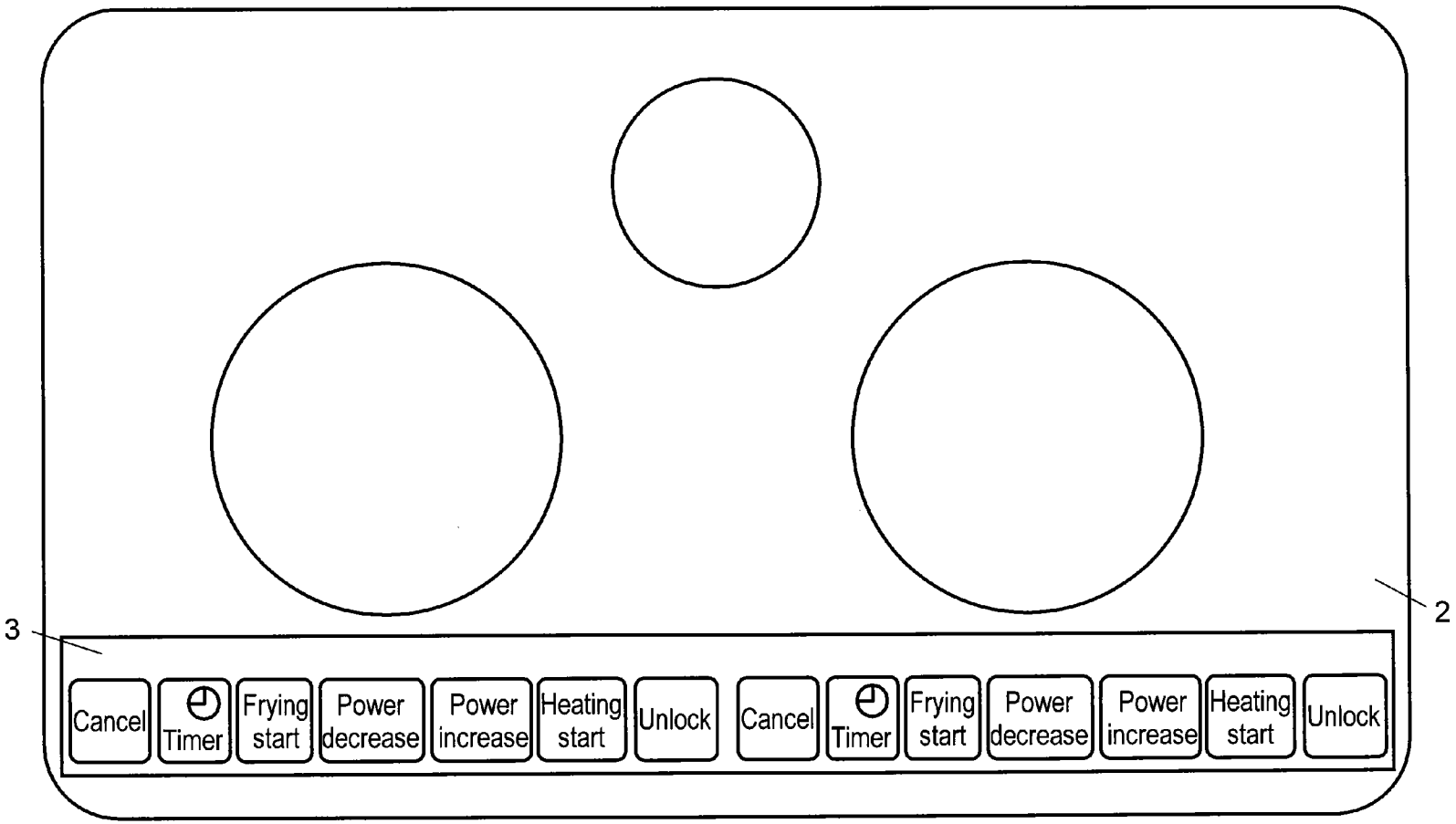
FIG. 2 is a top view showing a top plate of the heating cooker in accordance with the first and second exemplary embodiments of the present invention.
Figure 3:
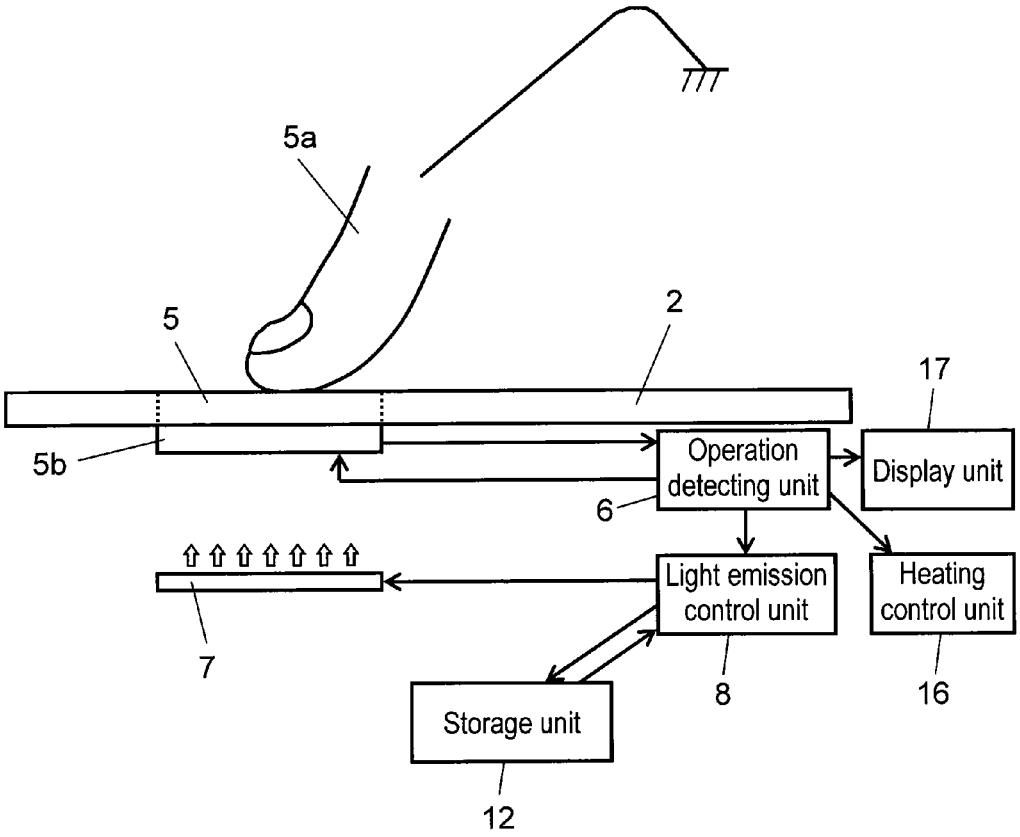
FIG. 3 is a block diagram showing a circuit part for executing a function of a top-face operation unit in accordance with the first exemplary embodiment of the present invention.

FIG. 2 is a top view of top plate 2 of a heating cooker in accordance with the first exemplary embodiment. FIG. 3 is a block diagram showing a sectional structure of the operation unit and a circuit part for executing a function of the operation unit of the heating cooker in accordance with the first exemplary embodiment.

Top plate 2 is formed of a heat-resistant glass, for example. An object to be heated is placed on the top face of the top plate, and a pattern for indicating heating unit 1 is formed on the bottom face thereof. For an induction heating cooker for induction-heating an object to be heated, the components of heating unit 1 include an induction heating coil for supplying a high-frequency current and generating a magnetic field. An area of top plate 2 is colored in a color different from the color of the other areas, or divided by a line. The area is not necessarily divided. In this manner, top-face operation unit 3, i.e. an operating area for the user, is provided.

With reference to FIG. 3, as the major components, top-face operation unit 3 and the circuit part for executing the functions thereof includes the following elements: electrostatic touch key 5 to be touched and pressed by finger 5*a*; operation detecting unit 6; light-guiding plate 7 constituting the operation unit light-emitting element for irradiating electrode 5*b* with light from the direction opposite to top plate 2 (in this case, from the downward direction to the upward direction); and light emission control unit 8. Light-guiding plate 7 guides incident light from a light source (not shown, a light-emitting diode (LED), for example), i.e. another component of the operation unit light-emitting element, so that electrode 5*b* is irradiated with light. Light-guiding plate 7 may be omitted, and a light source, such as an LED, may form the operation unit light-emitting element by itself.

Operation detecting unit 6 outputs detection results to display unit 17 and heating control unit 16. Display unit 17 gives display corresponding to the function which is assigned to electrostatic touch key 5 and instructed by pressing operation. Heating control unit 16 makes control corresponding to the function assigned to electrostatic touch key 5 and instructed by pressing operation. In electrostatic touch key 5, a capacitor is formed by electrode 5*b* on the rear face of top plate 2 and finger 5*a* on the top face of top plate 2. To electrode 5*b*, a high-frequency voltage is applied by an oscillating circuit (not shown) in operation detecting unit 6.

When finger 5*a* touches the top face of top plate 2 on electrode 5*b*, high-frequency voltage applied to electrode 5*b* is bypassed to the ground through top plate 2 and finger 5*a*. Operation detecting unit 6 detects that the voltage appearing in electrode 5*b* has dropped by a predetermined value or larger, thereby detecting that an operation has been performed on electrostatic touch key 5. In other words, operation detecting unit 6 applies an alternating current signal to electrode 5*b* and detects a capacitance change of electrode 5*b* with respect to the ground caused by a contact with the surface portion of top plate 2, thereby detecting an input operation of a finger on electrostatic touch key 5. An electrode (not shown) facing electrode 5*b* may be provided on the top face of top plate 2. This arrangement can stabilize the input sensitivity of electrostatic touch key 5.

Further, storage unit 12 is provided to store therein operation guiding information, i.e. information on operating procedures substantially covering the specifications of the heating cooker. Storage unit 12 pre-stores the following information: a key operable in each state; and when a plurality of keys are operable, a key more frequently used and highly expected for operation, and a key guided for operation with higher priority. Light emission control unit 8 controls light emission of light-guiding plate 7 according to the information stored in storage unit 12.

Figure 4A:
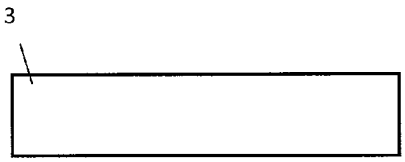
FIG. 4A is a top view showing the operation unit when a light-guiding plate thereof is unlit.
Figure 4C:
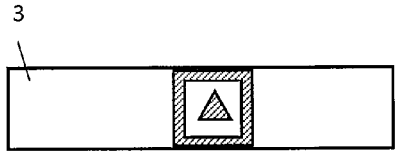
FIG. 4C is a top view showing the operation unit when the light-guiding plate is lit.
Figure 4B:
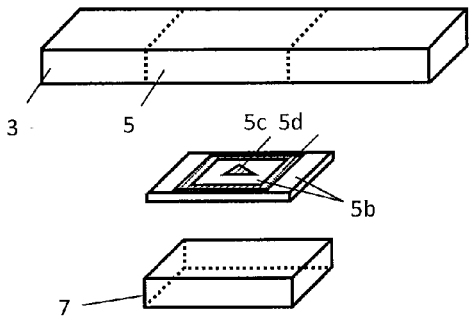
FIG. 4B is a perspective view showing the operation unit when the light-guiding plate is unlit.
Figure 4D:
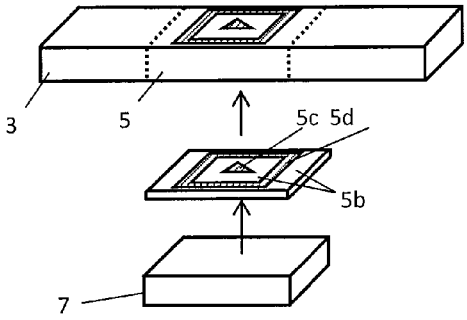
FIG. 4D is a perspective view showing the operation unit when the light-guiding plate is lit.

FIG. 4A is a top view showing top-face operation unit 3 when light-guiding plate 7 is unlit. FIG. 4B is a perspective view showing top-face operation unit 3 when light-guiding plate 7 is unlit. FIG. 4C is a top view showing top-face operation unit 3 when light-guiding plate 7 is lit. FIG. 4D is a perspective view showing top-face operation unit 3 when light-guiding plate 7 is lit.

Electrode 5*b* is formed of a metal film having low optical transparency, e.g. a copper foil, or a conductive coating having a predetermined light-blocking effect, e.g. a black conductive coating having conductivity. Thus, even when light-guiding plate 7 is lit, light does not transmit through or is unlikely to transmit through the top face of top plate 2. As shown by electrode 5*b* in FIGS. 4B and 4D, the conductive coating, such as a metal film, only corresponding to portions to be lit in a diagram or characters to be lit on top plate 2, is removed so that the removed portions form key display parts 5*c* and 5*d* and light can transmit through key display parts 5*c* and 5*d*. The hatched portions of electrode 5*b* in FIGS. 4B and 4D are key display parts 5*c* and 5*d*, and show that the conductive coating, such as a metal film, in the portions are removed.

In top-face operation unit 3, a film is printed in a color having low optical transparency (e.g. black, dark brown, and dark red) on the rear face of top plate 2. Thus, when light-guiding plate 7 is unlit as shown in FIG. 4B, no pattern is visible on the top face of top plate 2, as shown in FIG. 4A. When light-guiding plate 7 is lit as shown in FIG. 4D, the conductive coating portion of electrode 5*b* is not optically-transparent and has the same color as top plate 2. The radiation of light from light-guiding plate 7 transmits through key display parts 5*c* and 5*d*, and further through optically-transparent top plate 2 and a printed film constituting top-face operation unit 3. Thus, as shown in FIG. 4C, a key pattern appears and is visually identifiable. The hatched portions of top plate 2 in FIGS. 4C and 4D show that the portions are lit.

In this manner, light emission control unit 8 controls light emission by causing light-guiding plate 7 (operation unit light-emitting element) under electrode 5*b* to be lit so that the shape of electrode 5*b* is visible through top plate 2 and causing light-guiding plate 7 to be unlit so that the shape of electrode 5*b* is less visible. With this control, electrostatic touch key 5 looks as if the electrostatic touch key lights up and out.

In the descriptions with reference to FIGS. 4A through 4D, key display parts 5*c* and 5*d* in which the conductive coating is removed from electrode 5*b* are formed into rectangular and frame shapes, respectively, for example, and these shapes are visible on the top face of top plate 2. However, this is only an example for ease of explanation. Actually, as shown in FIGS. 5A through 5C and 6A through 6C, key display parts 5*c* and 5*d* are made of region display part 5*d* in which the conductive coating is removed in a frame shape and function display part 5*c* in which the metal is removed in the form of various kinds of characters, symbols, or diagrams. Thus function display part 5*c* indicating a function assigned to electrostatic touch key 5 and region display part 5*d* indicating an operating area of electrostatic touch key 5 are visible on the top face of top plate 2.

In top-face operation unit 3 disposed in a part of the area of top plate 2, a plurality of electrostatic touch keys 5 as described with reference to FIGS. 4A through 4D (14 keys in the example shown in FIG. 2) are arranged horizontally in combination with the same number of light-guiding plates 7.

Therefore, when light-guiding plate 7 included in electrostatic touch key 5 constituting this top-face operation unit 3 is lit, the characters, or a symbol in function display part 5*c* and the frame in region display part 5*d* as shown in FIG. 2 are visible with light emission on the top face of top plate 2 in top-face operation unit 3. Further, the portion of top plate 2 in this top-face operation unit 3 is printed in a color having low optical transparency. Thus, when light-guiding plate 7 is not lit, only the color is visible and characters or a symbol are invisible on the top face of the portion of top plate 2 in top-face operation unit 3. Alternatively, key display parts 5*c* and 5*d* may be made less visible when light-guiding plate 7 is unlit, instead of the structure in which no patterns are visible on the top face of the portion of top plate 2 in top-face operation unit 3.

Figure 5A:
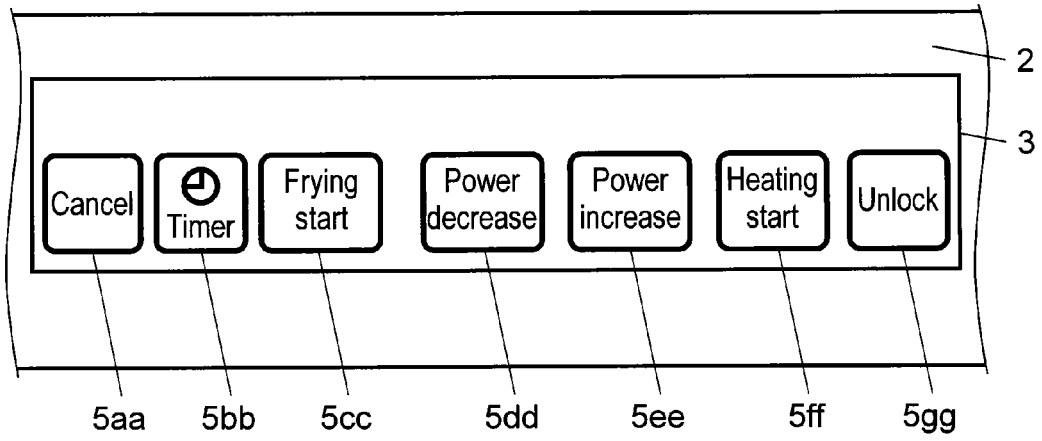
FIG. 5A is a top view showing a state in which all the light-guiding plates are lit in a part of the top-face operation unit.
Figure 5B:
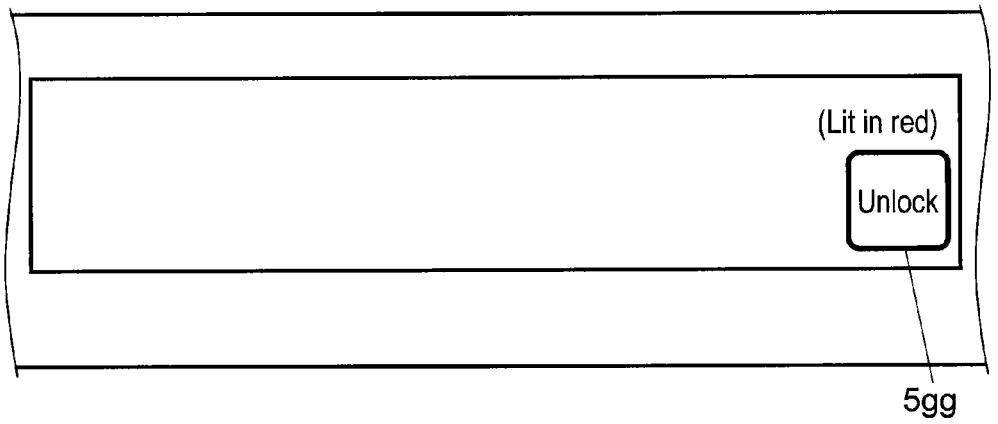
FIG. 5B is a top view showing a state in which one of the light-guiding plates is lit in a part of the top-face operation unit.
Figure 5C:
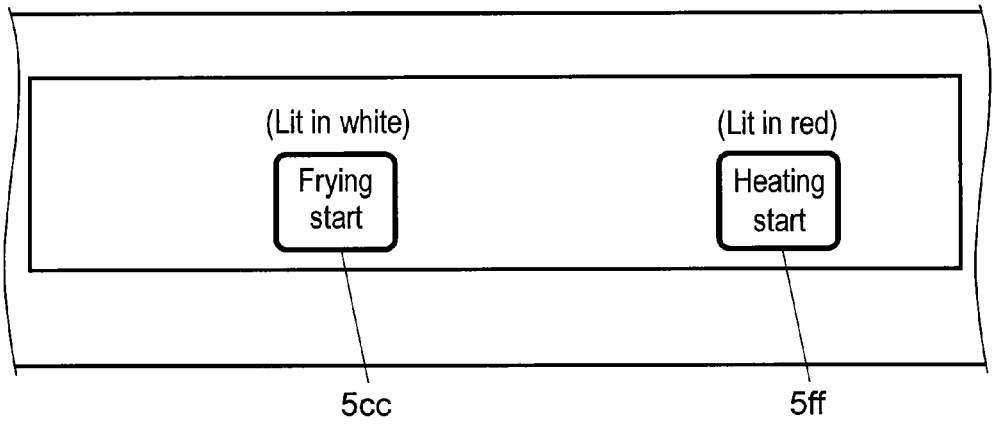
FIG. 5C is a top view showing a state in which two of the light-guiding plates are lit in a part of the top-face operation unit.

FIG. 5A is a top view showing a state in which all the light-guiding plates 7 are lit in a color in a part of top-face operation unit 3. FIG. 5B is a top view showing a state in which one of light-guiding plates 7 is lit in red in a part of top-face operation unit 3. FIG. 5C is a top view showing a state in which two of light-guiding plates 7 are lit (one light-guiding plate 7 in red and the other light-guiding plate 7 in white) in a part of the same top-face operation unit 3.

Electrostatic touch keys 5*aa* through 5*gg* show electrostatic touch keys corresponding to respective functions.

Specifically, electrostatic touch key 5*gg* is an unlocking key (hereinafter also referred to as "unlocking key 5*gg*"), and is used to release a lock state of the appliance in which all the other keys are inoperable in the lock state. Electrostatic touch key 5*cc* is a frying start key (hereinafter also referred to as "frying start key 5*cc*"), and is used to start frying operation in which heating output is controlled in the unlock state so that the oil in an object to be heated, e.g. a pot (not shown), is kept at a predetermined temperature. Electrostatic touch key 5*ff* is a heating start key (hereinafter also referred to as "heating start key 5*ff*") and is used to start heating other than frying in the unlock state.

Frying start key 5*cc* may also work as a stop key for stopping the operation when the key is operated during frying operation. Heating start key 5*ff* may also work as a heating stop key for stopping the heating operation during the heating operation.

Hereinafter, operation and action of the heating cooker as structured above is described.

First, the power is turned on/off by power supply switch 4*a*. While the power is not turned on, all the indications in the appliance are unlit and all the operations of the appliance are prohibited. After the power is turned off by power supply switch 4*a*, the operation of the appliance is prohibited. However, as required, control operations, such as lighting a high-temperature alarm lamp for a predetermined time period, and operating a cooling fan until residual heat is decreased, are performed. For power supply switch 4*a*, a mechanical contact type, for example, is used to improve reliability. The power supply switch is disposed on the front side as shown in FIG. 1. Alternatively, the power supply switch is disposed on the top face of the appliance, in kangaroo-type operation unit 4, or the like. A relay may by used to turn on/off the power. Power supply switch 4*a* may shuts off the main power supply line, or the control power supply. When the power is turned off by power supply switch 4*a*, all the electrostatic touch keys 5*aa* through 5*gg* are inoperable.

For a predetermined time period (e.g. several seconds) after the power is turned on by power supply switch 4*a*, all the electrostatic touch keys 5*aa* through 5*gg* light up in a color, as shown in FIG. 5A, to inform the user of the functions of the appliance. (Such a description is provided because electrostatic touch keys 5*aa* through 5*gg* look as if the keys light up although light-guiding plates 7 under electrostatic touch keys 5*aa* through 5*bb* are actually lit.) At this time, electrostatic keys may light up in any color. All the keys may light up in the same color, or in different colors. In this exemplary embodiment, all the keys light up in red, for example.

After the above predetermined time period, the heating cooker is changed into the lock state. As shown in FIG. 5B, light emission control unit 8 causes only unlocking key 5*gg* to light up (continuously light up or flash). At this time, the operable key is only unlocking key 5*gg*. At this time, electrostatic touch key 5*gg* may emit light in any color. In this exemplary embodiment, the key emits red light.

At this time, only unlocking key 5*gg* emits light and is visible to the user. Therefore, the user recognizes that only unlocking key 5*gg* is operable, and cannot see the other keys or know the existence thereof. As a natural result, the user cannot operate the other keys, and thus there is no possibility of inadvertently operating the keys other than unlocking key 5*gg*.

Only unlocking key 5*gg*, i.e. the operable operation unit, emits light and the other inoperable keys emit no light. Instead of this structure, unlocking key 5*gg* may emit light in a first light-emission color (e.g. red) and the other inoperable keys may emit light in a second color (e.g. green) so that the operable operation units are conspicuous. The operable keys are visually differentiated from the inoperable keys. This structure can prevent the inoperable keys from being erroneously operated.

When the user operates unlocking key 5*gg*, operation detecting unit 6 detects the operation of unlocking key 5*gg*, and informs light emission control unit 8 that unlocking key 5*gg* has been operated.

When unlocking key 5*gg* is pressed in the lock state, light emission control unit 8 determines that the appliance is brought into the unlock state, and that only frying start key 5*cc* and heating start key 5*ff* are operable, according to the operation guiding information stored in storage unit 12. Light emission control unit 8 causes unlocking key 5*gg* to be unlit and controls light-guiding plates 7 in a state of FIG. 5C in which light-guiding plates 7 of frying start key 5*cc* and heating start key 5*ff* are lit (continuously lit or flashed). When one of frying start key 5*cc* and heating start key 5*ff* is operated, the heating operation is caused by a heating coil in heating unit 1 so that the function assigned to the corresponding key is exerted. For example, when heating start key 5*ff* is operated, light-guiding plates 7 of timer cancel key 5*aa*, timer setting key 5*bb*, power decrease key 5*dd*, power increase key 5*ee* are selectively lit as electrostatic touch keys 5 to be operable next, i.e. electrostatic touch keys 5 necessary for detailed setting of heating functions (e.g. output setting and timer setting). Light-guiding plates 7 of heating start key 5*ff* and frying start key 5*cc* unnecessary for detailed setting and inoperable after the heating function is selected are unlit.

In this manner, when light emission control unit 8 detects that operable electrostatic touch key 5 is operated, the light emission control unit causes of light-guiding plates 7 of electrostatic touch keys 5 made inoperable to be unlit and causes light-guiding plates 7 of electrostatic touch keys 5 made operable next to be lit. Thereby, every time electrostatic touch key 5 is operated, only electrostatic touch keys 5 necessary for the next operation are displayed. Thus the user can easily find electrostatic touch keys 5 necessary for the operation.

The number of electrostatic touch keys 5 in which light-guiding plates 7 are lit after the release of the lock state is not limited to two as described above. At least one such key is sufficient.

Pressing operation of light-emitting key display parts 5*c* and 5*d* of electrostatic touch key 5 allows the operation command to be accepted. Thus it is preferable to cause key display parts 5*c* and 5*d* to flash when the operation command is accepted. This structure allows the user to visually confirm the acceptance of the operation, and thus can prevent the user from uselessly repeating the same operation many times without confirming that the input operation has been accepted.

At this time, in the two operable keys (frying start key 5*cc* and heating start key 5*ff*), heating start key 5*ff* has a higher frequency of use and higher priority. Thus heating start key 5*ff* having higher priority emits light in red, a more conspicuous color, and frying start key 5*cc* having lower priority emits light in hite, a relatively inconspicuous color.

Then, the user first operates light-emitting unlocking key 5*gg* in the lock state, and next operates frying start key 5*cc* and heating start key 5*ff* appearing after the lock state is released. In this manner, the user can recognize operable keys only at a glance of top-face operation unit 3, which eliminates the need for referring to the operating specifications during operation. Further, only operable electrostatic touch keys 5 are lit, which prevents erroneous operation of operating the other inoperative keys.

Further, electrostatic touch key 5 having higher priority emits light in a more conspicuous color that is different from the light-emission color of electrostatic touch key 5 having lower priority. Thus operation guiding in a more user-friendly and convenient manner allows the user to perform smoother operation.

Further, key display part 5*d*, i.e. a region display part indicating the operating range of the electrostatic touch key, is formed in a frame shape. Thus, when light-guiding plate 7 is lit, the operating range of electrostatic touch key 5 appears and the user can clearly recognize the range. Further, electrode 5*b* inside of region display part 5*d* is electrically coupled to electrode 5*b* outside of region display part 5*d* by capacitance coupling. Thus, when a high-frequency voltage is applied from operation detecting unit 6 to electrode 5*b* outside of region display part 5*d*, also electrode 5*b* inside of region display part 5*d* can exert the action of the electrode. When the conductive coating is formed by printing, the appearance of region display part 5*d* can be enhanced. The shape of region display part 5*d* is not limited to the frame shape. The region display part may be formed in an annular shape, for example. The region display part need not be formed in a continuous line, and may be formed in the shape of a broken line.

Function display part 5*c* for displaying the function assigned to electrostatic touch key 5 is provided in the key display part. Thus, when light-guiding light-guiding plate 7 is lit, function display part 5*c* for displaying the function of electrostatic touch key 5 appears, and the user can clearly recognize the function. Further, when top plate 2 on function display part 5*c* is touched, the finger is electrically coupled to electrode 5*b* outside of the function display part by capacitance coupling. Thus, a touching operation simply on function display part 5*c* allows the function of electrostatic touch key 5 to be exerted. Further, when the conductive coating of electrode 5*b* is formed by printing, the appearance of function display part 5*c* can be enhanced.

Key display parts 5*c* and 5*d* that the user looks at are formed in a cutting shape in electrode 5*b*. Thus the user only need to press visible key display parts 5*c* and 5*d*, and the possibility of erroneous operation is reduced. Further, a planar space for lighting electrostatic touch key 5 need not be specifically provided around electrode 5*b*. With this structure, when a necessary key is selected among a plurality of electrostatic touch keys 5, or when one electrostatic touch key 5 is used in common for execution of a plurality of functions so that the number of electrostatic touch keys 5 is reduced, the user can easily select and operate necessary electrostatic touch key 5 without erroneous operation. Thus the usability can be improved.

In the above structure, for a predetermined time period after the power is turned on by power supply switch 4*a*, all the electrostatic touch keys 5*aa* through 5*gg* are lit. Instead of this structure, a predetermined electrostatic touch key, e.g. an electrostatic touch key that has a frequently-used function or is related to an important function, may be selected and displayed.

Alternatively, the above structure in which all the electrostatic touch keys 5*aa* through 5*gg* are lit for a predetermined time period after the power-on by power supply switch 4*a* may be omitted. After the power-on, the appliance may provide another display and thereafter change into the lock state. Alternatively, the appliance may change into the lock state immediately after the power-on.

In the first exemplary embodiment of the present invention, the descriptions have been provided for one type of heating cooker, i.e. an induction heating cooker in which a high-frequency current is supplied to the induction heating coil and an object to be heated is induction-heated by a high-frequency magnetic field. The present invention is also applicable to a heating cooker that has a top plate disposed on the top face thereof and is used for cooking by another heat source, such as gas, halogen, a nichrome wire, and a sheath wire, in a similar manner.

Second Exemplary Embodiment

The second exemplary embodiment of the present invention has a primary appearance and structure similar to those shown in FIGS. 1 through 3. FIGS. 1 through 3 are also used for this exemplary embodiment, and the detailed descriptions of the appearance and structure are omitted.

Figure 6A:
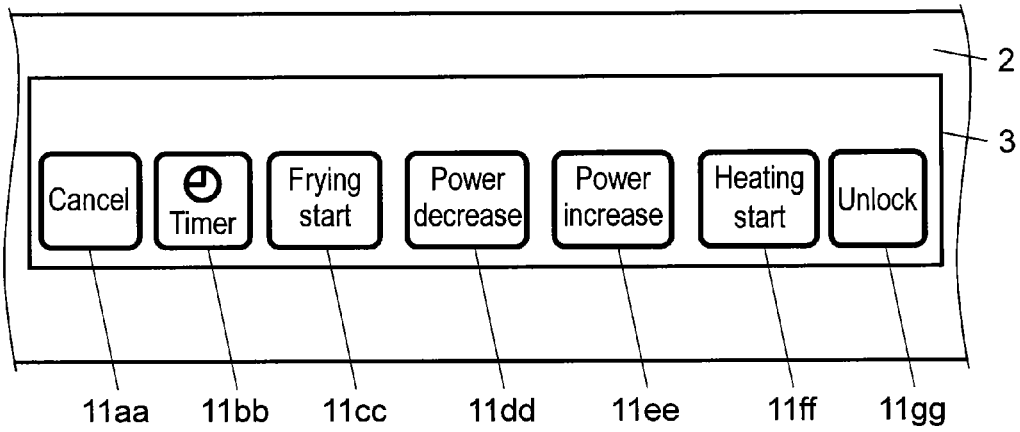
FIG. 6A is a top view showing a state in which all the light-guiding plates are lit in a part of the top-face operation unit in accordance with the second exemplary embodiment.
Figure 6B:
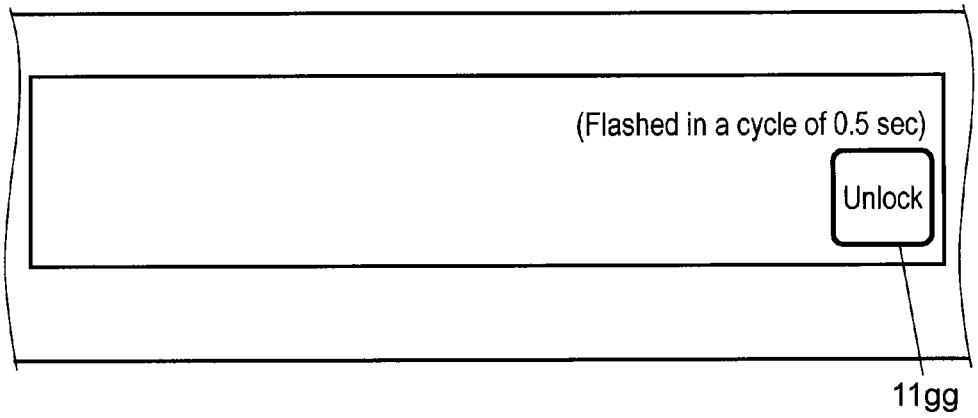
FIG. 6B is a top view showing a state in which one of the light-guiding plates is flashed.
Figure 6C:
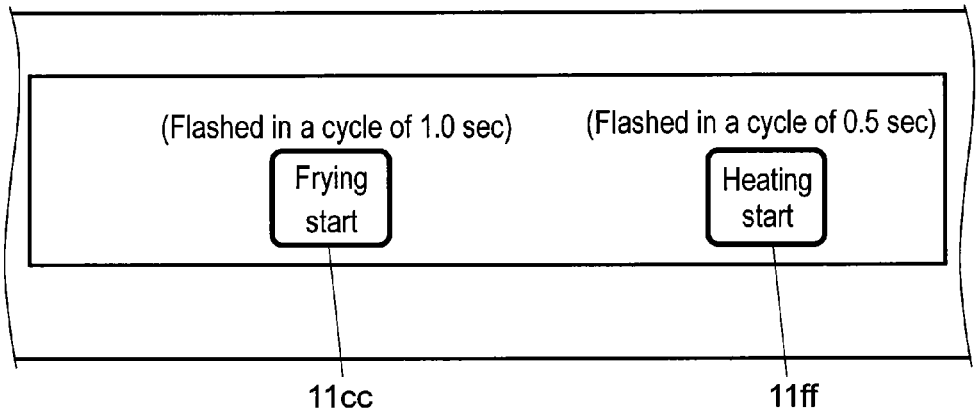
FIG. 6C is a top view showing a state in which two of the light-guiding plates are flashed in different cycles.

FIG. 6A is a top view showing a state in which all the light-guiding plates 7 are lit in a part of top-face operation unit 3 of a heating cooker in accordance with the second exemplary embodiment. FIG. 6B is a top view showing a state in which one of light-guiding plates 7 is lit in a relatively short cycle (of 0.5 sec). FIG. 6C is a top view showing a state in which one of light-guiding plates 7 is flashed in a predetermined relatively short cycle (of 0.5 sec), and another one of light-guiding plates 7 is flashed in a predetermined relatively long cycle (of 1.0 sec).

Electrostatic touch keys 11*aa* through 11*gg* show electrostatic touch keys 5 corresponding to respective functions.

Specifically, electrostatic touch key 11*gg* is an unlocking key (hereinafter also referred to as "unlocking key 11*gg*"), and is used to release a lock state of the appliance in which all the keys are inoperable in the lock state. Electrostatic touch key 11*cc* is a frying start key (hereinafter also referred to as "frying start key 11*cc*"), and is used to start frying in the unlock state. Electrostatic touch key 11*ff* is a heating start key (hereinafter also referred to as "heating start key 11*ff*"), and is used to start heating other than frying in the unlock state. Frying start key 11*cc* may also work as a stop key for stopping the operation when the key is operated during frying operation. Heating start key 11*ff* may also work as a heating stop key for stopping the heating operation during the heating operation.

Figure 7A:
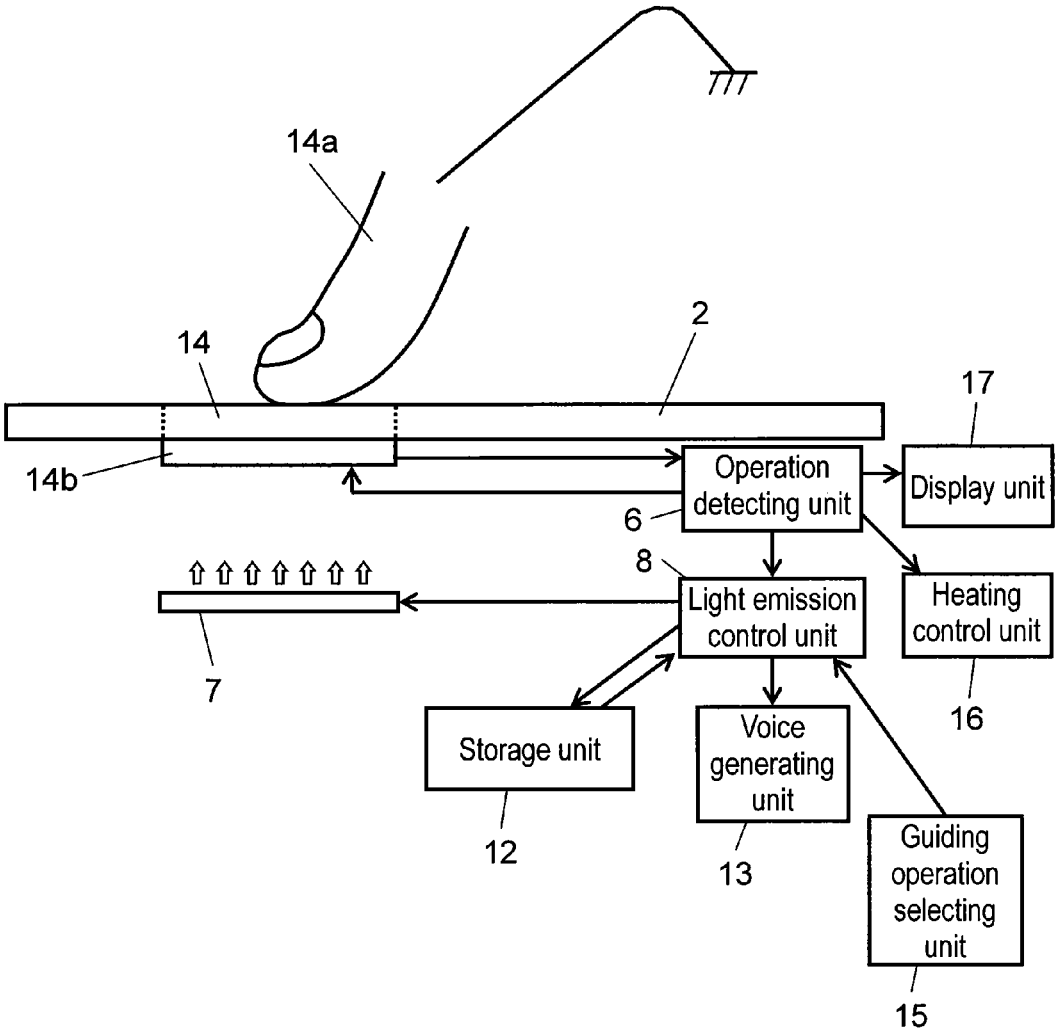
FIG. 7A is a block diagram showing a circuit part for executing a function of the top-face operation unit of the heating cooker in accordance with the second exemplary embodiment.

FIG. 7A is a block diagram of the operation unit of the heating cooker in accordance with the second exemplary embodiment of the present invention.

With reference to FIG. 7A, as the major components, the operation unit includes the following elements: storage unit 12 for storing operating procedures of the heating cooker; voice generating unit 13; electrostatic touch key 14, i.e. an operation unit having electrode 14*b* to be pressed by finger 14*a*; guiding operation selecting unit 15; heating control unit 16; and display unit 17.

In electrostatic touch key 14, a capacitor is formed by electrode 14*b* facing the surface on top plate 2 for receiving thereon an object to be heated (not shown), and finger 14*a* placed on the surface for receiving the object to be heated (not shown) thereon. To electrode 14*b*, a high-frequency voltage is applied.

When finger 14*a* touches the top face of top plate 2 on electrode 14*b*, high-frequency current supplied by an oscillating circuit (not shown) is bypassed to the ground through top plate 2 and finger 14*a*, and thus the impedance between electrode 14*b* and the common electric potential of the oscillating circuit is decreased. Operation detecting unit 6 detects that the voltage appearing in electrode 14*b* is dropped by the impedance decrease by a predetermined value or larger, thereby detecting that an operation has been performed.

Heating start key 11*ff* has a higher frequency of use than frying start key 11*cc*. Thus heating start key 11*ff* is guided for operation with higher priority. Storage unit 12 pre-stores the following information: a key operable in each state; and when a plurality of keys is operable, a key having a higher frequency of use and guided for operation with higher priority.

When the heating cooker is in the lock state as shown in FIG. 6B, light emission control unit 8 is informed by storage unit 12 that the operable key is unlocking key 11*gg*, and controls light emission of light-guiding plate 7 of unlocking key 11*gg* so that only unlocking key 11*gg* flashes in a cycle of 0.5 sec. Further, light emission control unit 8 issues, to voice generating unit 13, a command for generating a message that prompts the user for operation, and voice generating unit 13 generates a message.

At this time, as shown in FIG. 6A, all the electrostatic touch keys are lit for a predetermined time period to inform the user of the functions of the appliance. However, the present invention is not limited to such an exemplary embodiment, and all the electrostatic touch keys need not be lit necessarily.

When the user operates unlocking key 11*gg*, operation detecting unit 6 detects the operation of unlocking key 11*gg*, and informs light emission control unit 8 that unlocking key 11*gg* has been operated. When unlocking key 11*gg* is pressed in the lock state, light emission control unit 8 determines that the lock state is released and only frying start key 11*cc* and heating start key 11*ff* are operable, releases the flashed state of unlocking key 11*gg*, and returns the unlocking key to the unlit state. Thereafter, light emission control unit 8 is informed by storage unit 12 that the operable keys are frying start key 11*cc* and heating start key 11*ff* and heating start key 11*ff* is guided for operation with higher priority. Next, as shown in FIG. 6C, the light emission control unit controls light emission of light-guiding plates 7 so that frying start key 11*cc* flashes in a relatively inconspicuous cycle of 1.0 sec and heating start key 11*ff* flashes in a more conspicuous cycle of 0.5 sec, i.e. a different cycle.

Further, light emission control unit 8 issues, to voice generating unit 13, a command for generating a massage that prompts the user for operation, and voice generating unit 13 generates a message. Sound generating unit 13 is not limited to this exemplary embodiment, and may generate a message in combination with the light emission control of light-guiding plates 7 of the first exemplary embodiment.

User's eyes are guided to the key flashing in a more conspicuous short cycle, with higher priority. The electrostatic touch key having a higher frequency of use flashes in a shorter cycle. This operation allows the user's eyes to be guided to the electrostatic touch key having a higher frequency of use with higher priority when the user looks at top-face operation unit 3. Thus operation is facilitated. Further, only operable electrostatic touch key 11 lights up or flashes, and thus the other inoperative keys are not erroneously operated.

Further, by operation of guiding operation selecting unit 15, the user can disable the guiding operation function for causing light-guiding plates 7 to be lit or unlit according to whether electrostatic touch keys 5 are operable or inoperable. In this case, as shown in FIG. 6A, all the electrostatic touch keys 5 are kept lit irrespective of the state of the appliance, and no guiding operation is performed. After the user has learned the functions, arrangement, or operating method of the keys, performing no guiding operation eliminates annoying flashes of electrostatic touch keys 5.

In the above exemplary embodiments, a heat-resistant glass made of a crystallized ceramic, for example, is used for top plate 2. A transparent resin also can be used. Instead of coloring top plate 2 by forming a printed film, a printed film or evaporated film subjected to half-mirror processing may be formed on top plate 2, or electrode 5*b* on the side of top plate 2 and light-guiding plate 7 in the unlit state may have the same color. Similarly, this structure can make key display parts less visible when lighting plate 7 is unlit.

Figure 7B:
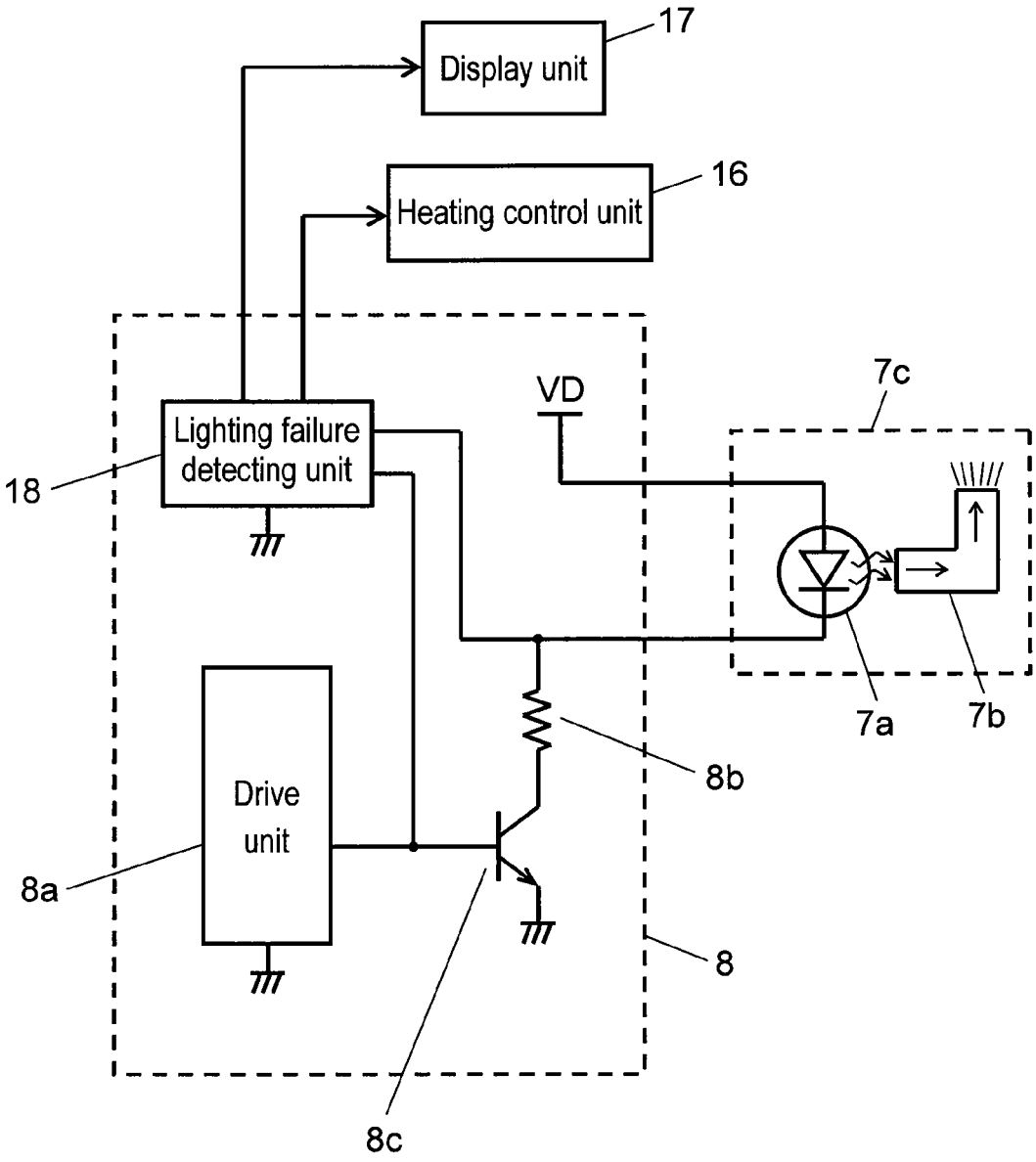
FIG. 7B is block diagram showing a light emission control unit that includes a lighting failure detecting unit in the heating cooker in accordance with the second exemplary embodiment.
Figure 8:
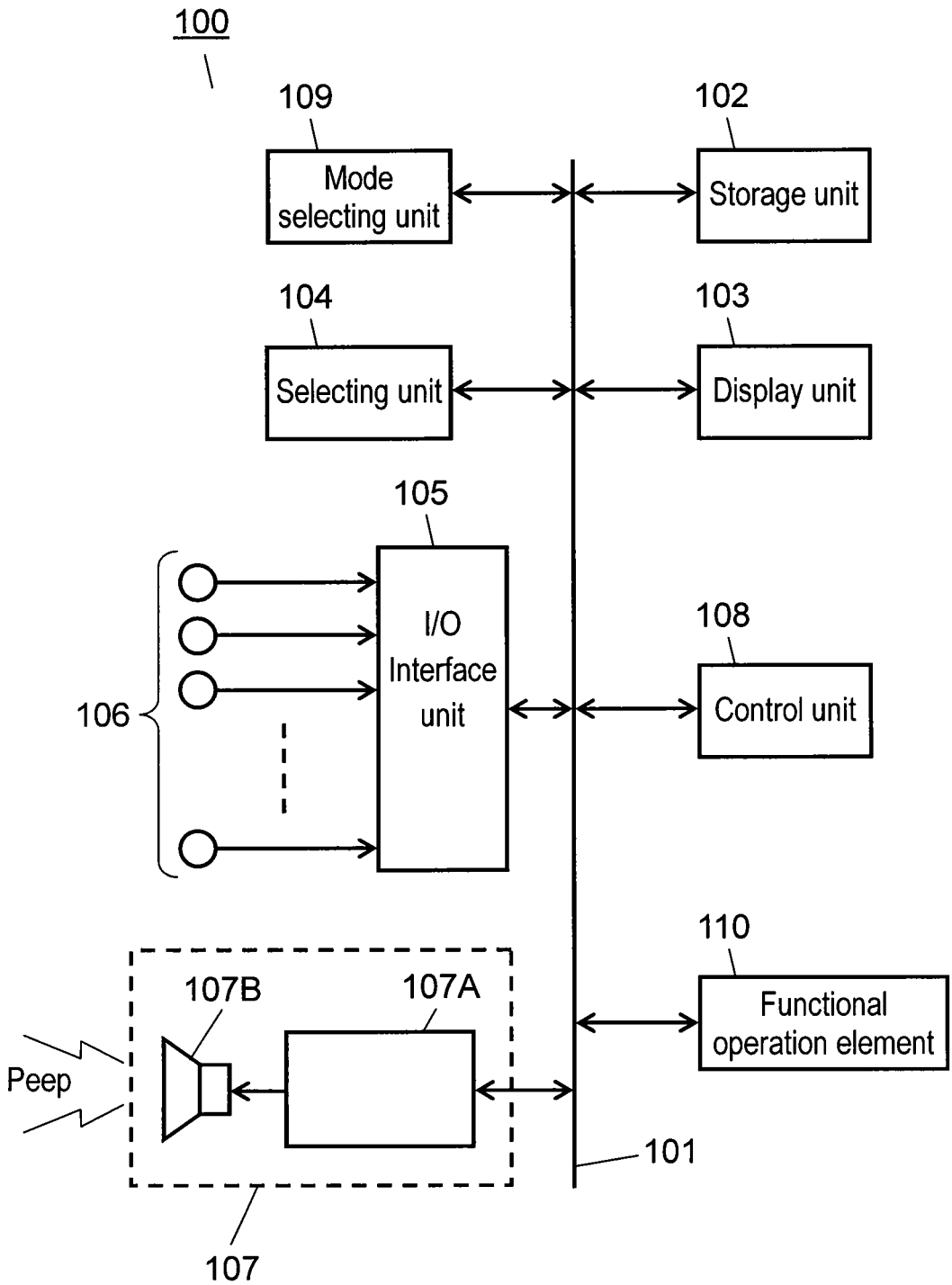
FIG. 8 is a block structural diagram showing an electronic appliance, i.e. a heating cooker, of a conventional example.

As shown in FIG. 7B, lighting failure detecting unit 18 may be provided. Light emission control unit 8 includes the following elements: a DC power supply (not shown) for supplying DC voltage VD; transistor 8*c* whose emitter is connected to the common potential; resistor 8*b* series-connected to the collector of transistor 8*c*; and drive unit 8*a* connected to the base of transistor 8*c* for driving transistor 8*b*. Operation unit light-emitting element 7*c* includes LED 7*a* as a light source of light-guiding plate 7*b*. Light-guiding plate 7*b* receives the light emitted by LED 7*a*, guides the light toward electrode 14*b*, and irradiates the electrode with the light. The DC voltage VD of light emission control unit 8 is connected to the anode of LED 7*a*. The series circuit of resistor 8*b* and transistor 8*c* is connected to the cathode of LED 7*a*. Thereby, the DC voltage VD is applied to the series circuit of LED 7*a*, resistor 8*b*, and transistor 8*c*. The voltage at the junction point between the cathode of LED 7*a* and resistor 8*b*, and a drive signal for driving transistor 8*c* from drive unit 8*a* are supplied to lighting failure detecting unit 18. Lighting failure detecting unit 18 supplies a signal to display unit 17 formed of a liquid crystal display (LCD) or an LED, and causes display unit 17 to display the detection results. Lighting failure detecting unit 18 also supplies a signal to heating control unit 16 and controls the heating operation of heating unit 1.

In the above structure, lighting failure detecting unit 18 monitors whether drive unit 8*a* drives transistor 8*c* or not. The lighting failure detecting unit determines whether the potential of the emitter of LED 7*a* is at a Lo level (substantially at the common potential) or at a Hi level (at a potential obtained by subtracting the forward voltage of LED 7*a* from the potential of the DC voltage VD), while drive unit 8*a* is driving. Lighting failure detecting unit 18 can determine that LED 7*a* has a disconnection and is unlit, by detecting that the potential of the emitter of LED 7*a* is at the Lo level (substantially at the common potential) while drive unit 8*a* is driving. Lighting failure detecting unit 18 can also determine that LED 7*a* has a short circuit and is unlit, by detecting that the potential of the emitter of LED 7*a* is equal to the potential of the DC voltage VD while drive unit 8*a* is driving.

As described above, lighting failure detecting unit 18 is provided for the following operation. When lighting failure detecting unit 18 detects that light-guiding light-guiding plate 7*b* is unlit due to a disconnection or a short circuit in LED 7*a* constituting operation unit light-emitting element 8, display unit 17 displays the occurrence of an error and informs the user of the disconnection or an lighting failure of electrostatic touch key 5. This structure can prevent the user from being bewildered. Further, when LED 7*a* or light-guiding light-guiding plate 7*b* is unlit due to a disconnection in LED 7*a*, a stop signal may be supplied to heating control unit 16 for controlling the heating operation of heating unit 1 so that heating is stopped or heating output is restricted to a small value. This structure can prevent the user from unintentionally touching electrostatic touch key 5 and starting heating operation, or causing hazardous situations from inadvertent heating operation.

The structures described in the first exemplary embodiment and the second exemplary embodiment can be appropriately combined as required.

INDUSTRIAL APPLICABILITY

The operation unit of the heating cooker of the present invention is particularly useful to an induction heating cooker having a top plate on the top face thereof, and is also usable as an operation unit of a heating cooker having a heat source, such as gas and halogen. When the operation unit is used for an appliance requiring complicated operation or an appliance having a limited number of switches, the user can recognize which operation to perform next without referring to the specifications of the product. Thus the operation can be performed smoothly. Further, operable switches are distinguished from the other inoperable switches by light-emission color. Thus erroneous operation can be reduced. Further, the switches are normally invisible and appear only when used. Thus the design feature of the operating portion is improved.

The invention claimed is:

1. A heating cooker comprising:

an optically-transparent top plate provided as a top face of an appliance;

a heating unit formed beneath the top plate;

electrostatic touch keys defined in the top plate and respectively assigned different functions to be performed including a lock release function, the electrostatic touch keys comprising electrodes arranged on a lower face of the top plate in alignment, respectively, with the electrostatic touch keys, the electrodes each being formed of a light-blocking conductive coating which is partially removed in a shape representative of a graphical or character image;

an operation detecting unit configured to detect an operation of the respective electrostatic touch keys, wherein the operation detection unit applies an alternating current signal to the respective electrodes and detects a change in a capacitance between the respective electrodes and a ground, which is caused by a contact by a user with the top plate at a location of the respective electrodes;

operation unit illuminators arranged in alignment, respectively, with the electrostatic touch keys to irradiate the electrostatic touch keys with light in a direction towards the top plate;

an illumination controller configured to turn on one of the operation unit illuminators to irradiate a corresponding electrostatic touch key to project the image formed by the electrode of the corresponding touch key so that the projected image is visible through the top plate and turn off the one operation unit illuminator to make the image less visible through the top plate; and a lighting failure detector configured to detect a breakdown of a light source of an operation unit illuminator; and a display unit configured to display an error, when the lighting failure detector detects that an operation unit illuminator fails to light up, to inform the user of the failure of the operation unit illuminator, wherein, upon being powered on, the heating cooker enters into a lock state in which only an electrostatic touch key assigned with the lock release function is operable among the electrostatic touch keys, and the illumination controller has only one of the operation unit illuminators turned on to irradiate the electrostatic touch key assigned with the lock release function in order to guide the user to contact the top plate at a location corresponding to the electrostatic touch key with the lock release function, and further wherein when the operation detecting unit detects an operation of the electrostatic touch key with the lock release function, the illumination controller has at least one of the operation unit illuminators turned on to irradiate at least one of the electrostatic touch keys, other than the electrostatic touch key with the lock release function, which is supposed to be operable subsequent to an operation of the electrostatic touch key with the lock release function, while having turned off any operation unit illuminators for any remaining electrostatic touch keys which are supposed to be inoperable subsequent to an operation of the electrostatic touch key with the lock release function.

2. The heating cooker of claim 1, wherein when the operation detecting unit detects that an operable electrostatic touch key is selectively operated, the illumination controller has turned off operation unit illuminators for electrostatic touch keys which become inoperable subsequent to an operation of the selected electrostatic touch key and has operation unit illuminators turned on to irradiate electrostatic touch keys which become operable subsequent to an operation of the selected electrostatic touch key.

3. The heating cooker of claim 1, wherein the illumination controller has an operation unit illuminator turned on to irradiate in a first color an electrostatic touch key assigned with a function more likely to be used and has an operation unit illuminator turned on to irradiate in a second color an electrostatic touch key assigned with a function less likely to be used, whereas having turned off an electrostatic touch key which is inoperable.

4. The heating cooker of claim 1, wherein the top plate is made of a glass having low optical transparency so as to make less visible through the top plate the shapes of the electrodes of electrostatic touch keys which are not irradiated.

5. The heating cooker of claim 1, wherein the top plate is made of a half mirror so as to make less visible through the top plate the shapes of the electrodes of electrostatic touch keys which are not irradiated.

6. The heating cooker of claim 1, wherein the top plate is made in a color substantially identical to a color exhibited by the electrodes which are not irradiated so that the shapes of the electrodes are less visible when not irradiated.

7. The heating cooker of claim 1, wherein a thin layer having low optical transparency is formed on the lower surface of the top plate so that the shapes of the electrodes are less visible when not irradiated.

8. The heating cooker of claim 1, further comprising a voice generator configured to generate a voice guidance regarding operable electrostatic touch keys and methods for operating the operable electrostatic touch keys.

9. The heating cooker of claim 1, further comprising a mode switch configured to switch to a second mode in which the illumination controller have all of the electrostatic touch keys visible from a first mode in which the illumination controller have operable electrostatic touch keys visible and inoperable electrostatic keys less visible.

10. A heating cooker of claim 1, wherein in response to an operation of an electrostatic touch key, the illumination controller controls a corresponding operation unit illuminator to flash in order to inform the user of reception of the operation.

11. The heating cooker of claim 1, further comprising a storage unit that stores an operating procedure is provided, and the illumination controller controls light emissions of the operation unit illuminators according to the operating procedure stored in the storage unit.

12. The heating cooker of claim 10, further comprising a storage unit that stores an operating procedure is provided, and the illumination controller controls light emissions of the operation unit illuminators according to the operating procedure stored in the storage unit.

13. A heating cooker comprising:

an optically-transparent top plate provided as a top face of an appliance;

a heating unit formed beneath the top plate;

electrostatic touch keys provided in the top plate and respectively assigned different functions to be performed, the electrostatic touch keys comprising electrodes arranged on a lower surface of the top plate in alignment, respectively, with the electrostatic touch keys, the electrodes each being formed of a light-blocking conductive coating which is partially removed in a shape representative of a graphical or character image;

an operation detecting unit configured to detect an operation of the respective electrostatic touch keys, wherein the operation detection unit applies an alternating current signal to the respective electrodes and detects a change in a capacitance between the respective electrodes and a ground, which is caused by a contact by a user with the top plate at a location of the respective electrodes;

operation unit illuminators arranged in alignment, respectively, with the electrostatic touch keys to light up the electrostatic touch keys in one of a first and second colors in a direction towards the top plate;

an illumination controller configured to turn on at least one of the operation unit illuminators to light up in the first color and at least one of the other operation unit illuminators to light up in the second color so that the image formed by the electrode of an operable electrostatic touch key is visible in the first color through the top plate, and the image formed by the electrode of an inoperable electrostatic touch key is visible in the second color through the top plate; and a lighting failure detector configured to detect a breakdown of a light source of an operation unit illuminator; and a display unit configured to display an error, when the lighting failure detector detects that an operation unit illuminator fails to light up, to inform the user of the failure of the operation unit illuminator, wherein every time the operation detecting unit detects that one electrostatic touch key is selectively operated, the illumination controller has one or more operation unit illuminators turned on to light up one or more electrostatic touch keys in the first color which are supposed to be operable subsequent to an operation of the one electrostatic touch key, while having one or more other operation unit illuminators turned on to light up one or more other electrostatic touch keys in the second color which are supposed to be inoperable subsequent to an operation of the one electrostatic touch key.

* * * * *